US012427560B2

(12) United States Patent
Wiedner

(10) Patent No.: US 12,427,560 B2
(45) Date of Patent: Sep. 30, 2025

(54) CROSS EDGE ROLLING

(71) Applicant: fischerwerke Gmbh & Co. KG, Waldachtal (DE)

(72) Inventor: Christoph Wiedner, Feldkirch (AT)

(73) Assignee: fischerwerke GmbH & Co. KG, Waldachtal (DE)

( * ) Notice: Subject to any disclaimer, the term of this patent is extended or adjusted under 35 U.S.C. 154(b) by 221 days.

(21) Appl. No.: 18/264,851

(22) PCT Filed: Feb. 1, 2022

(86) PCT No.: PCT/EP2022/052250
§ 371 (c)(1),
(2) Date: Aug. 9, 2023

(87) PCT Pub. No.: WO2022/175069
PCT Pub. Date: Aug. 25, 2022

(65) Prior Publication Data

US 2024/0307934 A1 Sep. 19, 2024

(30) Foreign Application Priority Data

Feb. 16, 2021 (DE) ..... 10 2021 103 576.7

(51) Int. Cl.
*B21B 1/22* (2006.01)

(52) U.S. Cl.
CPC ..... *B21B 1/224* (2013.01)

(58) Field of Classification Search
CPC ..... B21D 19/043; B21D 5/08; B21B 1/224
See application file for complete search history.

(56) References Cited

U.S. PATENT DOCUMENTS 252,460 A * 1/1882 Name ..... B21B 1/088 72/225
4,433,565 A * 2/1984 Preller ..... B21D 5/08 72/202

(Continued)

FOREIGN PATENT DOCUMENTS

CN 107812816 A 3/2018
EP 2313216 B1 4/2011

(Continued)

OTHER PUBLICATIONS

Translation of JP-04059103.*
International Search Report Mailed May 12, 2022 in corresponding international application No. PCT/EP2022/052250.

*Primary Examiner* — Bobby Yeonjin Kim
(74) *Attorney, Agent, or Firm* — Renner, Otto, Boisselle & Sklar, LLP

(57) ABSTRACT

A cross edge rolling process for increasing a thickness of a strip in longitudinal edge strips on both longitudinal sides of the strip. According to the invention, this is achieved in that firstly a step extending in the longitudinal direction of the strip is produced by means of a roll profiling process, wherein the strip is supported during the cross edge rolling process on said step against a compression force acting transversely to the strip, so that the strip is not compressed outside the longitudinal edge strip. After the edging process for increasing the thickness of the longitudinal edge strips, the strip is bent by means of a roll profiling process to form a C-profile rail.

13 Claims, 5 Drawing Sheets

(56) References Cited

U.S. PATENT DOCUMENTS

| | | | | | |
|---|---|---|---|---|---|
| 4,920,777 | A * | 5/1990 | Kosak | B21B 1/082 | 72/229 |
| 6,016,602 | A * | 1/2000 | Kanemitsu | B21D 53/28 | 72/110 |
| 6,112,409 | A * | 9/2000 | Jaekel | B21B 1/088 | 72/204 |
| 8,959,975 | B2 * | 2/2015 | Welser | B21D 5/08 | 72/110 |
| 2021/0371946 | A1 * | 12/2021 | Stuth | B21C 37/042 | |

FOREIGN PATENT DOCUMENTS

| | | | | |
|---|---|---|---|---|
| JP | 04059103 A * | 2/1992 | | B21B 1/08 |
| WO | 9014178 A1 | 11/1990 | | |

* cited by examiner

CROSS EDGE ROLLING

This application is a national phase of International Application No. PCT/EP2022/052250 filed Feb. 1, 2022, which claims priority to German Application No. DE 10 2021 103 576.7 filed Feb. 16, 2021, each of which is hereby incorporated herein by reference in its entirety.

The invention relates to a method of a strip for thickening a longitudinal edge strip of a strip by means of a cross edge rolling process having the features of the preamble of Claim 1. The method A "strip" here is understood to mean a strip of basically any length with a preferably constant and flat, in particular rectangular, cross-section, which strip is in particular at least 5 times and preferably at least 10 times as wide as thick, wherein a thickness of the strip is a smaller and a width is a larger dimension of the strip transverse to its length. The strip consists of a plastically deformable material, in particular of metal. An elastic deformability of the strip is not desired per se but is also not excluded and in reality is normally the case.

"Rolling" is a process of forming under pressure conditions the strip in a pass between a plurality of rollers. A method in which the strip is compressed in its transverse direction, i.e., becomes narrower, wherein a longitudinal edge strip of the strip becomes thicker, is referred to as "cross edge rolling." A section extending in the longitudinal direction of the strip having preferably constant width at a longitudinal edge of the strip is referred to as a "longitudinal edge strip." The strip can be cold-rolled or hot-rolled.

Patent EP 2 313 216 B1 discloses a cross edge rolling of a metal strip, in which longitudinal edge strips on two longitudinal edges of the metal strip are formed and thickened in a plurality of successive stages into strips with a triangular cross-section, and which are subsequently bent at right angles to the same side of the metal strip by means of a roll forming process. For the cross edge rolling process, the strip is guided between an upper roller and a lower roller, wherein edging rollers at both longitudinal edges compress the metal strip in the transverse direction thereof so that it becomes narrower and the two longitudinal edge strips become thicker and triangular in cross-section. At the end of the cross edge rolling process the lower roller is narrower than the metal strip and the upper roller is as wide as the metal strip. The upper roller has bevels, i.e., circumferential, oblique or frustoconical faces at transitions from a circumference to end faces of the upper roller, against which bevels the edging rollers press the longitudinal edge strips of the metal strip. The edging rollers are disk-shaped and have circumferential annular steps with a circumferential groove on an inner edge, which press the metal strip against the upper roller and compress it in the transverse direction. The two edging rollers are arranged obliquely at angles between 92° and 100° to axes of the upper roller and of the lower roller.

It is an object of the invention to propose a method which obliquely compresses exclusively or in any case predominantly only one longitudinal edge strip of a strip and thickens it in the process. Outside the longitudinal edge strip, the strip is not to be deformed per se, wherein the invention does not exclude a deformation of the strip outside the longitudinal edge strip.

This object is achieved according to the invention via the features of Claim 1. Before or at the same time as the cross edge rolling process, the strip is bent in opposite directions along two parallel bending lines extending in a longitudinal direction of the strip, so that a step extending in a longitudinal direction of the strip, i.e., parallel to the longitudinal edge, is formed, which step delimits a longitudinal edge strip from the strip, which is to be compressed transversely to the strip by means of a rolling process, from a remaining part of the strip. The transverse compression direction in which the cross edge rolling process takes place extends in particular at an angle of 45° to 135°, in particular 70° to 110°, and preferably perpendicularly to a longitudinal center plane of the strip which is perpendicular to the transverse direction and is in particular a plane of symmetry. The "transverse direction" is understood here to mean the direction parallel to the transverse extension of the strip. The transverse compression direction is thus preferably parallel to the transverse direction but may also be somewhat oblique thereto. In particular, the transverse compression direction may vary during the cross edging process, i.e., for example, be somewhat oblique in a first stage and be parallel to the transverse direction in a second stage.

The step, which may also be considered as a right-angled bend, is used to support the strip or the longitudinal edge strip in the transverse direction against a compression force which acts on the strip or the longitudinal edge strip transversely to the strip in a simultaneous or subsequent cross edge rolling process, as a result of which it is possible to compress transversely to the strip exclusively or in any case substantially only the longitudinal edge strip of the strip between the longitudinal edge of the strip and the step extending parallel to the longitudinal edge and to not form the strip otherwise, i.e., on a side, facing away from the longitudinal edge, of the step previously produced by means of the bending process, wherein the invention does not in any case exclude a forming of the strip outside the longitudinal edge strip. A bending process of the strip at more than two bending lines before or simultaneously with the cross edge rolling process is possible.

Preferably, the cross edge rolling process takes place in such a way that the longitudinal edge strip becomes thicker from the second-closest bending line to the longitudinal edge and up to the longitudinal edge. This does not exclude a thickening taking place at least minimally beyond it. In the case of two bending lines, the thickening thus takes place at least from the longitudinal edge up to the inner bending line. In other words, the cross edge rolling process extends into the region of the step. Due to the support according to the invention, however, at least no significant forming takes place beyond the step in the direction of the center of the strip. The step extending in the longitudinal direction, i.e., parallel to the longitudinal edge of the strip, is in particular bent by means of a roll profiling process, which is also referred to as "roll forming."

One embodiment of the invention provides that the strip is compression-rolled in the transverse direction by an edging roller, which is arranged laterally in relation to the strip and presses against the longitudinal edge of the strip, and in the process is supported by a support roller on the step, which is bent simultaneously or previously and extends parallel to the longitudinal edge of the strip, against the compression force exerted on the longitudinal edge transversely to the strip by the edging roller, so that only or substantially only the longitudinal edge strip between the step and the longitudinal edge of the strip is acted on by the compression force and is compressed transversely to the strip, wherein the longitudinal edge strip is thickened.

In one embodiment of the invention, the support roller is arranged on a side which is designated here as the "upper side" and extends from the one longitudinal edge to an opposite longitudinal edge of the strip. The term "upper side" refers to the side toward which the step is increased. During the rolling process, the upper side does not necessarily have to be "at the top." During the cross edge rolling process, an end face of the support roller supports the strip on the step extending parallel to the longitudinal edge, against the compression force of the edging roller pressing against the longitudinal edge of the strip. An "end face" is understood here to mean a surface that is not parallel to the axis of rotation.

Preferably, longitudinal edge strips on both longitudinal edges of the strip are transversely compressed, for which purpose steps, extending parallel to the longitudinal edges, for supporting against the compression forces acting oppositely transversely to the strip are bent beforehand. In particular, the strip is formed symmetrically to a longitudinal center plane.

A development of the invention provides that after the cross edge rolling process, the strip is formed, in particular by means of a roll profiling/roll forming process, into a C-profile rail, i.e., into a type of rectangular tube with a continuous longitudinal slot in the longitudinal direction in one side of the tube. Such C-profile rails are used as mounting rails for fastening to walls and ceilings.

At the inner bending line, which is remote from the longitudinal edge of the strip, the strip is bent in one embodiment of the invention between 45° and 90°, in particular between 50° and 80°. In the case of more than two bending lines, the innermost bending line is meant.

In one embodiment of the invention, an end face of the support roller, which supports the strip on the step parallel to the longitudinal edge of the strip against the compression force of the edging roller acting transversely to the strip, has an angle of between 45° and 90°, in particular between 50° and 80°, to an axis of rotation of the support roller.

At a compression point, where a circumferential compression face of the edging roller presses against the longitudinal edge of the strip, the compression face is, in one embodiment of the invention, at an angle between 70° and 85° to an axis of the support roller so that during the edging process, the compression face pushes the step extending parallel to the longitudinal edge of the strip, against the end face of the support roller that supports the step of the strip against the compression force of the edging roller acting transversely to the strip.

In particular, the axes of the support roller and of the edging roller are at an angle of 70° to 90° and preferably perpendicular to one another.

One embodiment of the invention provides that the edging roller has a support face, in particular a annular-disk-shaped support face, which rests on the step of the strip and supports the step during the cross edge rolling process against bending in the direction in which the step is increased relative to the remaining part of the strip.

Preferably, the bending process of the step takes place with two bending lines, wherein the size of the bending angles differs at most by 45°, in particular at most by 30° and preferably at most by 20°. What is meant are the bending angles that are reached in the state in which the cross edge rolling process takes place simultaneously or subsequently. As a result of the bending angles whose sizes are identical or at least similar, it is achieved that the step has approximately a parallel offset and the longitudinal edge stands in the transverse direction so that the cross edge rolling process can take place in the transverse direction.

Preferably, the step has a height corresponding to 0.5 to 1.5 times the thickness of the strip in the region of the step.

The features and feature combinations, embodiments, and designs of the invention as mentioned above in the description, as well as the features and feature combinations as mentioned below in the description of figures and/or drawn in a figure, are usable not only in the combination indicated or shown in each case; rather, in principle any other combinations are also usable, or said features can be used individually. Embodiments of the invention are possible which do not have all features of a dependent claim. Individual features of a claim can also be replaced by other disclosed features or feature combinations. Embodiments of the invention are possible which do not have all the features of the exemplary embodiment, but rather a fundamental arbitrary part of the features of the exemplary embodiment.

The invention is explained in more detail below with reference to the drawing. The figures show successive stages of the method according to the invention in a simplified and schematic representation.

Figure 5:
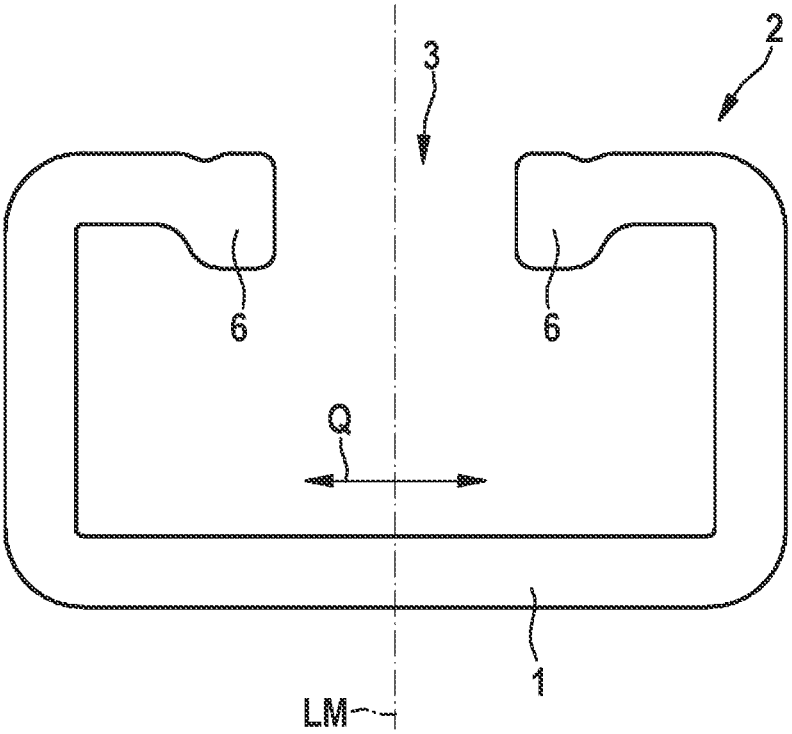
FIG. 5 shows the same strip bent to form a C-profile rail.

In its passage, in a plurality of stages, the C-profile rail 2 shown in FIG. 5 is produced from a strip 1, said C-profile rail having a rectangular tube cross-section with a continuous longitudinal slot 3 in a transverse center of one side. The figures show successive forming stages, wherein further forming stages (not shown) between the forming stages shown in the figures can take place or a plurality of forming stages may also be combined. The figures show the forming on one longitudinal side of the strip 1; on an opposite longitudinal side, the strip 1 is formed in the same way. The strip 1 is formed symmetrically to a plane of symmetry which is perpendicular to the originally flat cross-section of the strip 1 and extends in a transverse center of the strip 1 in the longitudinal direction thereof and is a longitudinal center plane LM. The strip 1 extends with its transverse extension in a transverse direction Q, to which the longitudinal center plane LM is perpendicular.

The strip 1 basically has any length; it may consist of long pieces of a length of several meters or may even be unwound from a coil. In the exemplary embodiment, it has a flat rectangular cross-section with a thickness between 1.5 millimeters to 2.5 millimeters and is between 30 and 60 times as wide as thick. The strip 1 consists of a plastically deformable material, in particular is made of steel, of an aluminum alloy or generally of metal. An elastic deformability of the strip 1 is rather undesirable because it may impair the plastic deformation, but an elastic deformability of the strip 1 is not excluded and is in any case unavoidable to a small degree in practice.

The strip 1 is guided in each forming stage between an upper roller 4 and a lower roller 5, which roll on two opposite large sides of the strip 1. In the exemplary embodiment, the upper roller 4 and the lower roller 5 are cylindrical rollers with parallel axes, which have a gap of the thickness of the strip 1 or somewhat less in order to clamp the strip 1 between the upper roller 4 and the lower roller 5 and possibly also to reduce the thickness of the strip 1. The upper roller 4 and the lower roller 5 do not have to be arranged horizontally, or one above the other.

Figure 1:
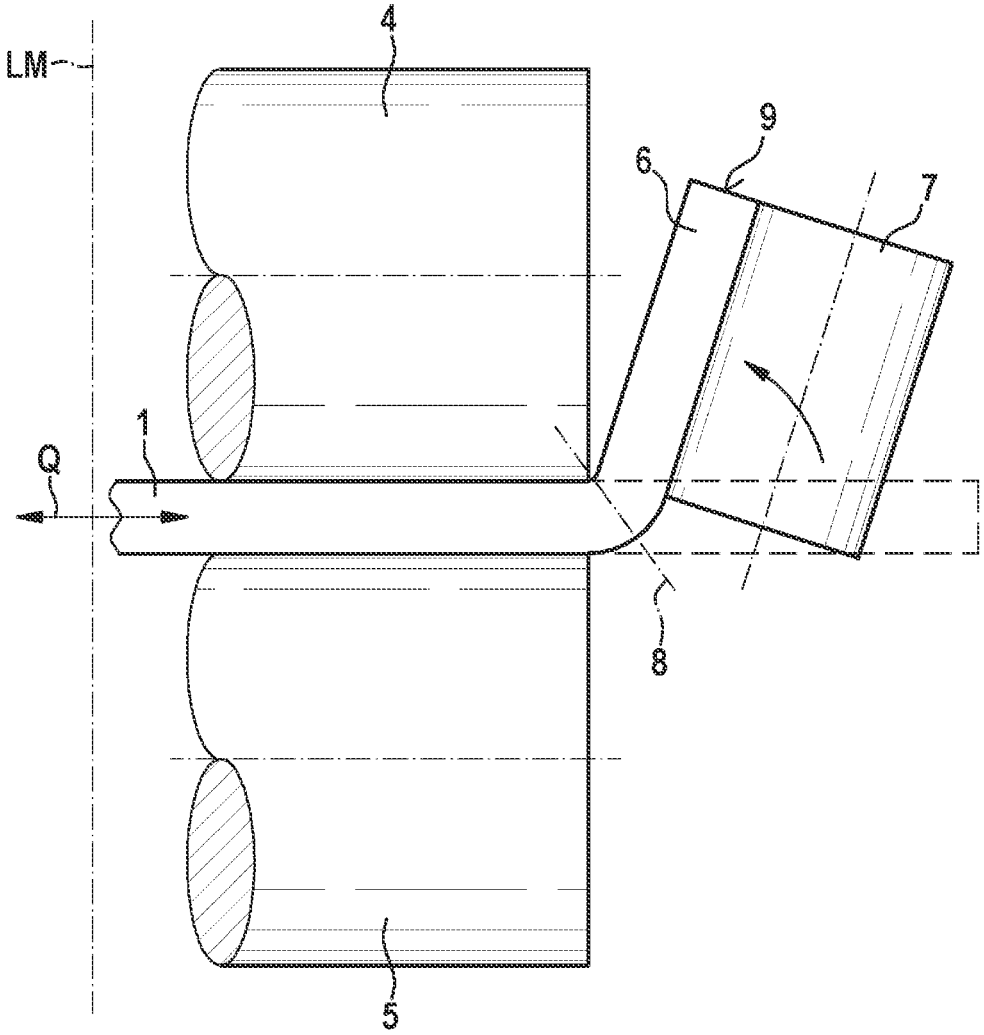
FIG. 1 shows a strip in a longitudinal view at a rolling station in a first stage of producing a step.

In their passage, as shown in FIG. 1, longitudinal edge strips 6 on both longitudinal sides of the strip 1 are bent in the same direction at on each side of a first or inner bending line 8, which extends parallel to longitudinal edges 9 of the strip 1, by means of first bending rollers 7 arranged laterally of the upper roller 4 and of the lower roller 5. The longitudinal edge strips 6 are bent by up to 90°. In the exemplary embodiment, the longitudinal edge strips 6 of the strip 1 are bent overall by approximately 70° to 80° in a plurality of steps, of which FIG. 1 shows a final step. The first bending rollers 7 are likewise cylindrical rollers or even frustoconical rollers, the axes of which are in one plane with the axes of the upper roller 4 and of the lower roller 5. Rollers other than bending rollers 7 are not excluded by the invention.

Figure 2:
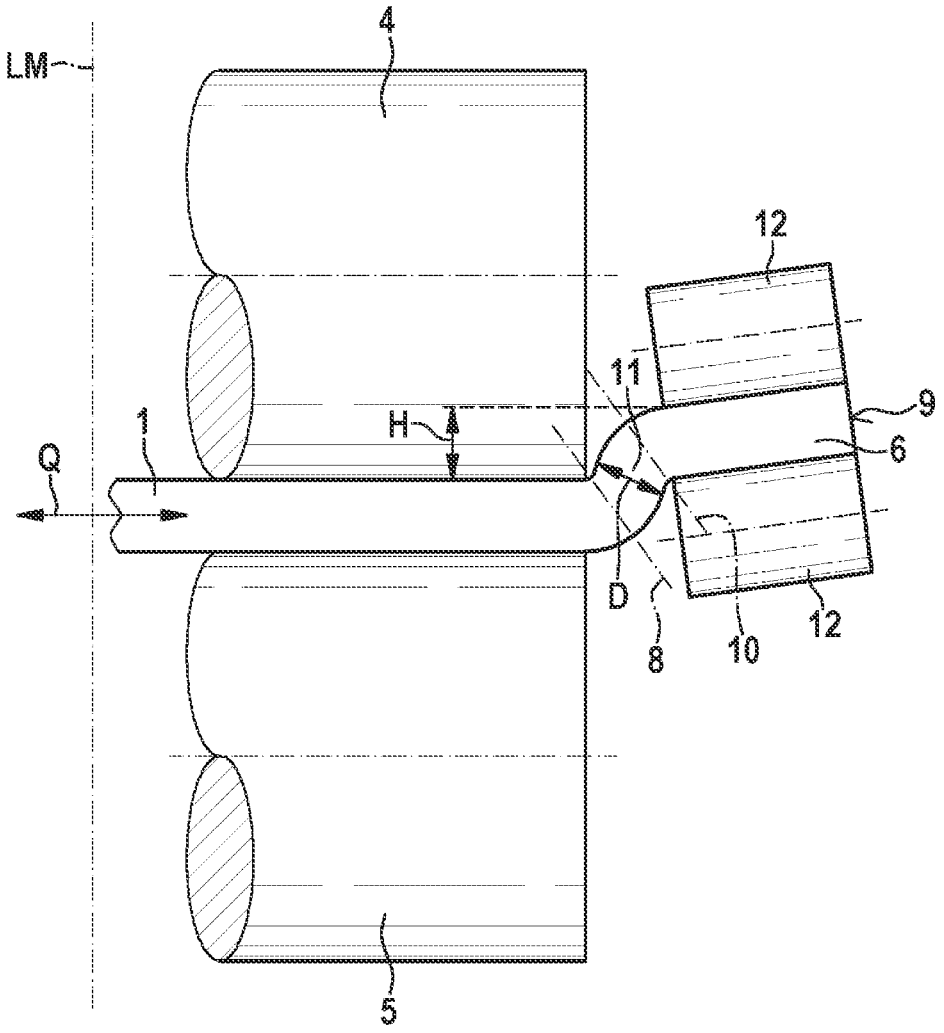
FIG. 2 shows the same strip in a second stage of producing the step.

The longitudinal edge strips 6 on both sides of the strip 1 are then bent at second or outer bending lines 10 in a direction opposite to previously. The bending lines 8, 10 are represented in the figure by dot-dashed lines, which themselves are not parallel to the longitudinal edges 9 but correspond in each case to the bisector of the bending angle. That is to say, the bending lines 8, 10 extend perpendicular to the dot-dashed lines and perpendicular to the plane of representation. The outer bending lines 10 extend parallel to the inner bending lines 8 and parallel to the longitudinal edges 9 of the strip 1 at a distance of approximately the thickness of the strip 1 outside the inner bending lines 8—i.e., the outer bending lines 10 are closer to the longitudinal edges 9 than are the inner bending lines 8. The bending process of the longitudinal edge strips 6 at the outer bending lines 10 in the direction opposite to previously preferably likewise takes place in a plurality of stages, of which FIG. 2 shows a last stage, until the longitudinal edge strips 6 between the outer bending lines 10 and the longitudinal edges 9 extend parallel to or at an acute angle of approximately 10° to 20° to the strip 1 in the exemplary embodiment between the inner bending lines 8. In the exemplary embodiment, the longitudinal edge strips 6 at the outer bending lines 10 are bent back less far than they are bent at the inner bending lines 8 so that the longitudinal edge strips 6 extend obliquely in the direction in which they are also bent at the inner bending lines 8.

As a result of the double bending at the two bending lines 8, 10 in opposite directions, a step 11 is formed which is continuously parallel to the longitudinal edges 9 of the strip 1 in the longitudinal direction of the strip 1. As a result of the bending of the strip 1 at the inner bending lines 8 by approximately 70° to 80° in the exemplary embodiment, a portion of the strip 1 between the inner and the outer bending line 8, 10 is at an angle of approximately 100° to 110° to the central portion of the strip 1 between the inner bending lines 8. In other words, the size of the bending angles at the two bending lines 8, 10 differs by approximately 10° to 20°. In this way, the step 11 has approximately a parallel offset. A height H of the step 11 corresponds approximately to the thickness D of the strip 1 in the region of the step 11.

For bending at the outer bending lines 10, the longitudinal edge strips 6 in the exemplary embodiment are guided between two second bending rollers 12 which in the longitudinal edge strips 6 rest on the upper and lower sides of the strip 1. The second bending rollers 12 are likewise cylindrical or frustoconical rollers, the axes of which are in one plane perpendicular to the passage plane of the strip 1 with the axes of the upper roller 4 and of the lower roller 5.

The bending of the strip 1 at the bending lines 8, 10 is a roll profiling process, which is also referred to as a roll forming process.

Instead of the separate first and second bending rollers 7, 12, the double bending may also take place by correspondingly shaped upper and lower rollers (not shown) which extend into the region of the longitudinal edge strip 6 and there have a stepped shape corresponding to the step 11. In this way, the two bending lines 8, 10 can in particular also be produced simultaneously, wherein this can in turn be distributed over several forming stages with upper and lower rollers arranged one behind the other. However, the double bending, i.e., the creation of the step 11, preferably takes place in a single stage.

After the bending process of the strip 1 at the inner bending lines 8 in the one direction and at the outer bending lines 10 in the opposite direction, the strip 1 is compression-rolled in a transverse compression direction QS by means of laterally arranged edging rollers 13, which press transversely to the strip 1 against the longitudinal edges 9 thereof. The axes of the edging rollers 13 are perpendicular to the axis of the upper roller 4. Alternatively, the cross edge rolling process can also already take place simultaneously with the bending process of the step 11, in particular if the step 11 is produced by correspondingly shaped upper and lower rollers (not shown). In this case, an edging roller projects between the upper roller and the lower roller. For greater clarity, however, the cross edge rolling process is shown here as a separate, subsequent stage. The edging rollers 13 have a frustoconical or cylindrical compression section 14 which rolls on the longitudinal edges 9 of the strip 1, and a disk-shaped support section 15 which rests on the upper side of the longitudinal edge strips 6 of the strip 1. In this case, the upper side is the side in which the longitudinal edge strips 6 are offset relative to the central portion of the strip 1 between the inner bending lines 8 by the double bending in the opposite directions—In other words, the side toward which the steps 11 increase. The support sections 15 of the edging rollers 13 prevent the longitudinal edge strips 6 during the edging process of the strip 1 in the transverse direction Q from being bent back in the direction opposite to previously during the bending. Perforated-disk-shaped faces of the support sections 15 resting on the longitudinal edge strips 6 may also be considered as support faces 16. Differing from the exemplary embodiment, support rollers that are separate from the edging rollers 13 or even stationary support faces (not shown) may be provided.

During the cross edge rolling process, the steps 11 of the strip 1 on the upper side thereof between the inner and the outer bending lines 8, 10 rest against end faces 17 of the upper roller 4, which forms a support roller 18, which supports the strip 1 or the longitudinal edge strips 6 of the strip 1 on the step 11, i.e., in the portion extending in the longitudinal direction of the strip 1 between the inner and the outer bending lines 8, 10, in the transverse direction Q of the strip 1 against a compression force exerted by the edging rollers 13 transversely to the strip 1 on the longitudinal edges 9 of the strip 1. As a result of the support at the step 11, only the longitudinal edge strips 6 of the strip 1 are compression-rolled, whereby they become thicker and narrower in the transverse direction Q of the strip 1. The end faces 17 of the upper roller 4 forming the support roller 18 may be flat radial surfaces or conical or frustoconical, i.e., they have an angle between 45° and 90° to a circumferential surface of the support roller 18.

Figure 3:
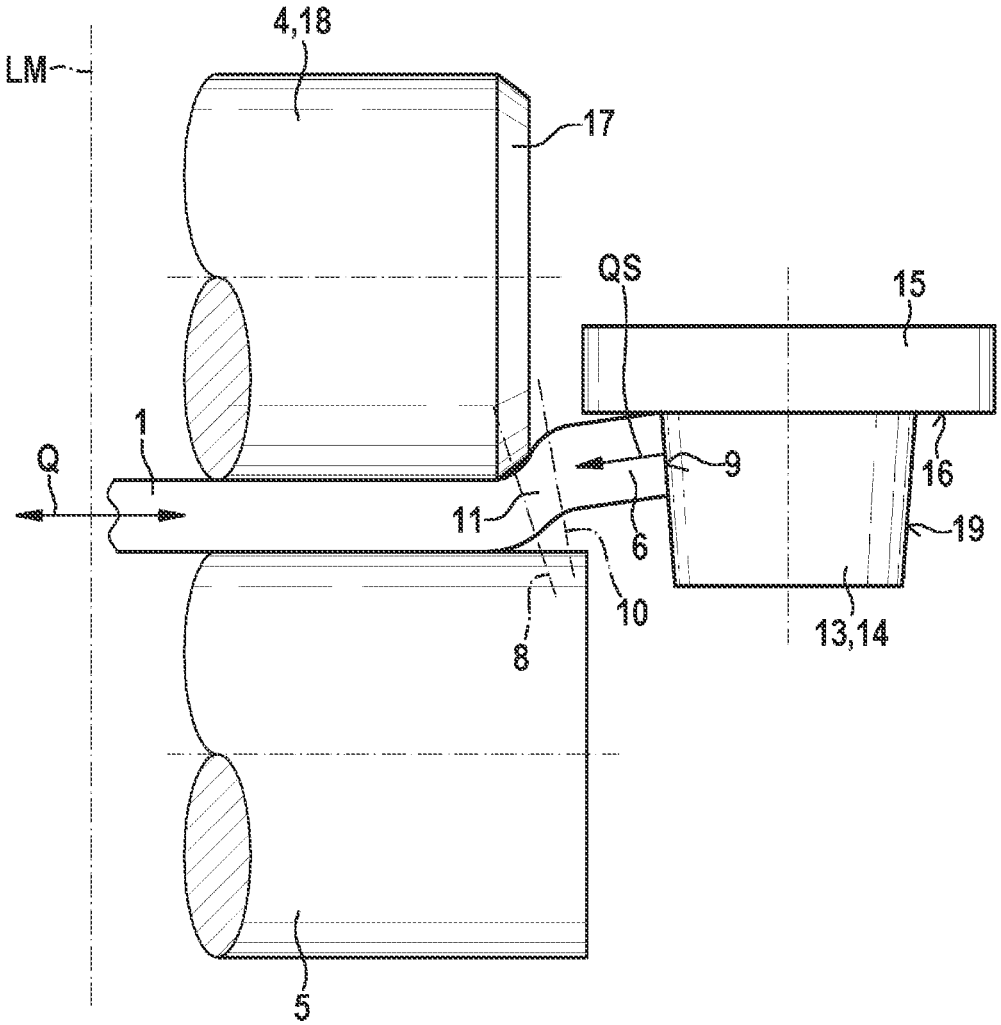
FIG. 3 shows the same strip in a first stage of a cross edge rolling process.

At a compression point, a circumferential surface of the frustoconical compression section 14 of the edging rollers 13 has an angle between approximately 85° and 70° to the axis of the support roller 18 (FIG. 3). The circumferential surface of the compression section 14 of the edging rollers 13 may also be considered as a compression surface 19. The compression point is the point at which the compression surface 19 or the edging rollers 13 rest against the longitudinal edge 9 of the strip 1 during the edging process. The transverse compression direction QS, in which compression takes place in the first stage of the cross edge rolling process, thus does not extend perfectly perpendicularly to the longitudinal center plane LM.

Figure 4:
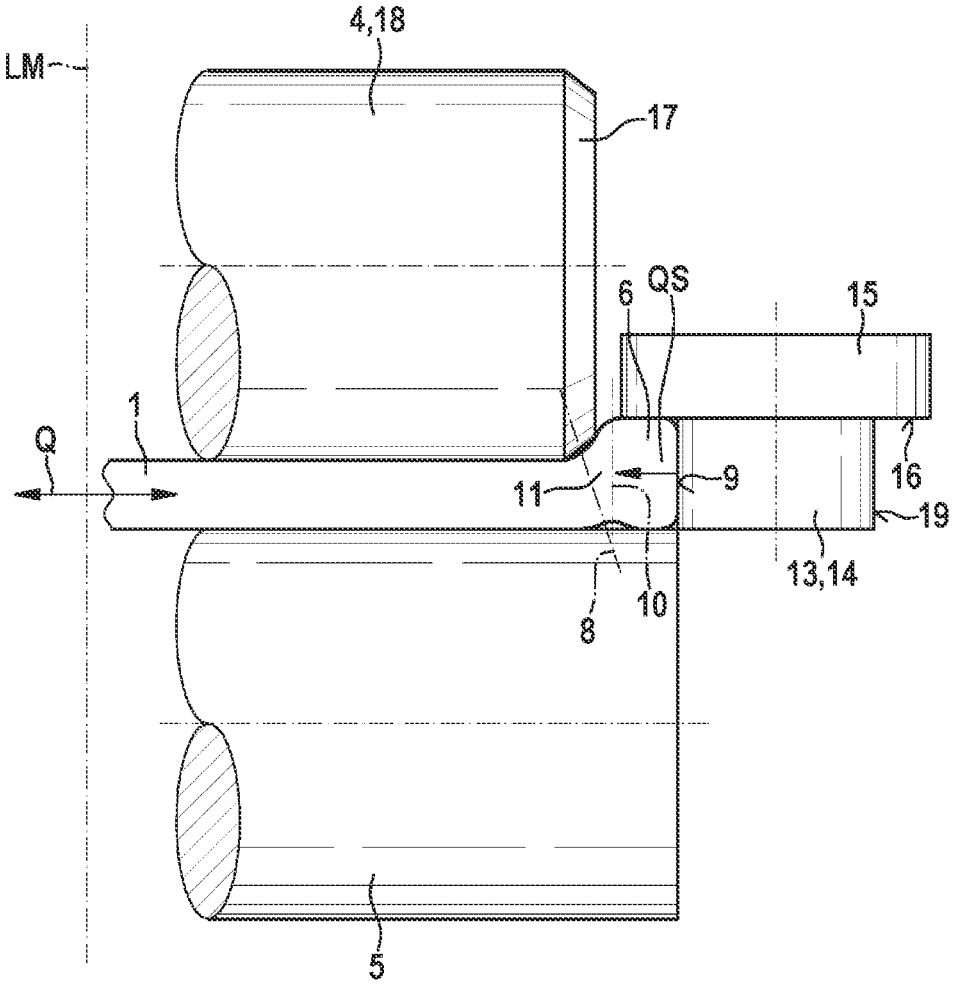
FIG. 4 shows the same strip in a second stage of a cross edge rolling process.

In the last compression stage, shown in FIG. 4, the lower roller 5 is so wide that the strip 1, including the longitudinal edge strips 6 thereof, rests on it. As a result, a flat large side of the strip 1 is achieved, which in the exemplary embodiment has a production-related groove extending in the longitudinal direction of the strip 1, with a rounded cross-section in the region of the bending lines 8, 10. The flat large side of the strip 1 following the cross edge rolling process forms an outer side on the C-profile rail 2 shown in FIG. 5. In the stage of the cross edge rolling process shown in FIG. 4, the transverse compression direction QS is perpendicular to the longitudinal center plane LM since the compression surface 19 is cylindrical here. As can be seen clearly in FIG. 4, the longitudinal edge strip 6 becomes thicker up to the inner bending line 8 and even somewhat beyond it. The cross edge rolling process thus extends up to the region of the step 11.

FIGS. 3 and 4 show a first and a second cross edge rolling stage, wherein the longitudinal edge strips 6 can be transversely compression-rolled in further stages (not shown) so that the forming in the individual stages is smaller. The strip 1 can be cold or hot compression-rolled.

After the cross edge rolling process of the longitudinal edge strips 6 of the strip 1, the strip 1 is bent in a plurality of stages (not shown) to form the C-profile rail 2 shown in FIG. 5. The bending process takes place in a pass by means of a roll profiling process (roll forming) as in the bending process of the step 11.

LIST OF REFERENCE SIGNS

Cross Edge Rolling

- 1 Strip
- 2 C-profile rail
- 3 Longitudinal slot
- 4 Upper roller
- 5 Lower roller
- 6 Longitudinal edge strip
- 7 First bending roller
- 8 Inner bending line
- 9 Longitudinal edge
- 10 Outer bending line
- 11 Step
- 12 Second bending roller
- 13 Edging roller
- 14 Compression section
- 15 Support section
- 16 Support face
- 17 End face
- 18 Support roller
- 19 Compression face
- D Thickness of the strip 1 in the region of the step 11
- H Height of the step 11
- LM Longitudinal center plane
- Q Transverse direction
- QS Transverse compression direction

The invention claimed is:

1. A method for thickening a longitudinal edge strip of a strip made of a plastically deformable material, the method comprising:

transversely compression-rolling the strip in a transverse direction so that the strip becomes narrower and at the same time the longitudinal edge strip becomes thicker, wherein the longitudinal edge strip is a section of the strip extending along a longitudinal direction of the strip at a longitudinal edge of the strip;

before or simultaneously with the transversely compression-rolling, bending the strip in opposite directions along two parallel bending lines, wherein the bending lines extend in a longitudinal direction of the strip and define the longitudinal edge strip, thereby forming a step extending in the longitudinal direction of the strip; and supporting the strip at the step during the transversely compression-rolling of the longitudinal edge strip.

2. The method according to claim 1, further comprising performing the bending of the strip at the bending lines by roll profiling process.

3. The method according to claim 1, wherein the transversely compression-rolling comprises:

compression-rolling the strip in a transverse compression direction by an edging roller, wherein the edging roller is arranged laterally in relation to the strip and presses against a longitudinal edge of the strip; and supporting the strip by a support roller at the step that extends parallel to the longitudinal edge of the strip, wherein the support roller supports the strip in the transverse direction (Q) of the strip against a compression force exerted by the edging roller.

4. The method according to claim 3, wherein the support roller is arranged on an upper side of the strip, and wherein an end face of the support roller supports the strip against the compression force of the edging roller at the step extending in the longitudinal direction of the strip.

5. The method according to claim 1, further comprising:

bending the strip at two bending lines parallel to the longitudinal edges on both longitudinal edges of the strip; and, transversely compression-rolling both longitudinal edges of the strip to form a profile symmetrical in relation to a longitudinal center plane, wherein the longitudinal center plane is perpendicular to the transverse direction of the strip.

6. The method according to claim 1, further comprising bending the strip after the transversely compression-rolling to form a C-profile rail.

7. The method according to claim 1, wherein the bending of the strip comprises bending the strip at an inner bending line by an angle between 45° and 90°, wherein the inner bending line is remote from the longitudinal edge of the strip.

8. The method according to claim 4, wherein the end face of the support roller is at an angle between 45° and 90°, relative to a circumferential surface of the support roller.

9. The method according to claim 3, wherein at a compression point pressing against the longitudinal edge of the strip, a circumferential compression surface of the edging roller is at an angle between 70° and 85° to an axis of rotation of the support roller.

10. The method according to claim 3, wherein the edging roller includes a support surface that rests on the longitudinal edge strip of the strip.

11. The method according to claim 1, wherein the bending of the strip creates of the step with two bending lines and wherein the size of the bending angles at the two bending lines differs at most by 45°.

12. The method according to claim 1, wherein the step has a height which corresponds to 0.5 to 1.5 times the thickness of the strip in the region of the step.

13. The method according to claim 1, wherein the transversely compression-rolling causes the longitudinal edge strip to become thicker in a region extending from the longitudinal edge to a second-closest bending line, wherein the second-closest bending line is the second bending line counted from the longitudinal edge.

* * * * *